US007892314B2

(12) United States Patent
Hammond

(10) Patent No.: US 7,892,314 B2
(45) Date of Patent: Feb. 22, 2011

(54) POWDER METAL COMPOSITION CONTAINING MICRONIZED DEFORMABLE SOLIDS AND METHODS OF MAKING AND USING THE SAME

(75) Inventor: Dennis L Hammond, Richfield, OH (US)

(73) Assignee: Apex Advanced Technologies, LLC, Cleveland, OH (US)

( * ) Notice: Subject to any disclaimer, the term of this patent is extended or adjusted under 35 U.S.C. 154(b) by 761 days.

(21) Appl. No.: 11/162,058

(22) Filed: Aug. 26, 2005

(65) Prior Publication Data

US 2007/0048166 A1 Mar. 1, 2007

(51) Int. Cl.
*C22C 1/05* (2006.01)

(52) U.S. Cl. ..... 75/252; 419/38; 419/37; 419/32

(58) Field of Classification Search ..... 419/38, 419/39; 75/252
See application file for complete search history.

(56) References Cited

U.S. PATENT DOCUMENTS

| | | | | |
|---|---|---|---|---|
| 4,002,474 | A | 1/1977 | Blachford | |
| 4,106,932 | A | 8/1978 | Blachford | |
| 5,045,277 | A | 9/1991 | Penkunas et al. | |
| 5,332,537 | A | 7/1994 | Hens et al. | |
| 5,342,563 | A * | 8/1994 | Quinn et al. | 264/681 |
| 6,093,761 | A | 7/2000 | Schofalvi | |
| 6,204,316 | B1 | 3/2001 | Schofalvi | |
| 6,316,393 | B1 | 11/2001 | Thomas et al. | |
| 6,376,585 | B1 | 4/2002 | Schofalvi et al. | |
| 6,679,935 | B2 | 1/2004 | Hammond | |
| 6,846,862 | B2 | 1/2005 | Schofalvi et al. | |
| 6,860,918 | B2 | 3/2005 | Ozaki et al. | |
| 2004/0038067 | A1 | 2/2004 | Ozaki et al. | |
| 2004/0077508 | A1 | 4/2004 | Hammond | |
| 2004/0144206 | A1 | 7/2004 | Tavares et al. | |
| 2004/0144207 | A1 | 7/2004 | Tavares et al. | |
| 2004/0175286 | A1 | 9/2004 | Hammond | |
| 2005/0044988 | A1 | 3/2005 | Hammond | |
| 2005/0118053 | A1 * | 6/2005 | Phillips et al. | 419/36 |

OTHER PUBLICATIONS

"Cryo-Grind Size Reduction Systems" Product literature published by Air Products © 2004.*

* cited by examiner

*Primary Examiner*—Roy King
*Assistant Examiner*—Christopher Kessler
(74) *Attorney, Agent, or Firm*—Rankin, Hill & Clark LLP

(57) ABSTRACT

The present invention provides powder metal compositions and methods of making and using the same. Powder metal compositions according to the invention include base metal particles, a lubricant that transforms from a solid phase material to a viscous, liquid phase material during pressing, and a micronized deformable solid material. The micronized deformable solid material fills at least a portion of the void space between the base metal particles during pressing, which allows at least a portion of the lubricant to migrate as a viscous liquid phase material to the interface between the surface of the green compact and the wall of the mold cavity to provide lubrication that reduces the ejection force necessary to remove the green compact from the mold cavity.

5 Claims, No Drawings

POWDER METAL COMPOSITION CONTAINING MICRONIZED DEFORMABLE SOLIDS AND METHODS OF MAKING AND USING THE SAME

FIELD OF THE INVENTION

The present invention relates to substantially dry powder metal compositions and methods of making and using the same. More particularly, the present invention relates to dry powder metal compositions containing micronized deformable solids and methods of making and using the same.

BACKGROUND OF THE INVENTION

Powder metal compositions are frequently used to produce metal parts in applications wherein casting, forging or other metal processing techniques are not cost effective. The fabrication of parts using powder metal compositions includes the steps of placing the powder metal composition in the cavity of a mold, pressing the powder metal composition to form a green compact, removing the green compact from the cavity, and firing the green compact to burn out any organic material and densify and consolidate the metal powder into a final part.

Lubricants are employed in pressed powder metallurgy, particularly during the pressing step when the powder is compressed in the cavity to form the green compact. External lubricants, which facilitate the removal of the green compact from the cavity after pressing by ejection, are typically sprayed onto the walls of the cavity prior to filling the cavity with the powder metal composition. Internal lubricants are mixed with the powder metal composition to facilitate slippage of the individual metal particles against each other so that the pressing forces are spread uniformly and the density of the resulting green compact can be made to be as uniform as possible throughout its cross-section.

The use of external lubricants is time-consuming, and it is often difficult to apply a uniform coating of a liquid external lubricant to the cavity walls, particularly when fabricating complex parts. To eliminate the need for external lubricants, some powder metal compositions are formulated to contain an excessive amount of an internal lubricant. In this sense, the phrase "excessive amount" means that the powder metal composition is formulated to contain an amount of an internal lubricant that is greater than would otherwise be necessary to facilitate compaction of the individual metal particles. The use of an excessive amount of an internal lubricant permits the internal lubricant to be in close proximity to the surface of the green compact and provide some lubrication between the green compact and the wall of the mold cavity after pressing. This approach, while effective at diminishing the need for an external lubricant, tends to adversely affect the powder metal composition and metal part making process.

For example, the presence of an excessive amount of internal lubricant in a powder metal composition tends to reduce the flow characteristics of the powder metal composition into the mold cavity, thereby reducing the rate at which the pressing operation can proceed. Furthermore, the presence of an excessive amount of an internal lubricant tends to detrimentally affect the density of the green compact (sometimes referred to as "green density"), because the lubricant takes up volume or space within the mold cavity and interferes with the compressibility of the individual metal particles. At high compaction forces, an excessive amount of an internal lubricant tends to cause delamination and cracking in the green compact, which produces defects in the final part. Furthermore, the presence of an excessive amount of an internal lubricant requires a longer and more complex heating cycle during sintering to remove the larger amount of organic material present. Thus, the use of an excessive amount of an internal lubricant tends to contribute to low final density in the metal part, protracted furnace time, and can lead to the formation of cracks and blisters during firing.

SUMMARY OF THE INVENTION

Powder metal compositions according to the invention comprise base metal particles, a lubricant that transforms from a solid phase material to a viscous, liquid phase material during pressing, and a micronized deformable solid material. The micronized deformable solid material fills at least a portion of the void space between the base metal particles during pressing, which allows at least a portion of the lubricant to migrate as a viscous liquid phase to the interface between the surface of the green compact and the wall of the mold cavity and thereby provide lubrication that reduces the ejection force necessary to remove the green compact from the mold cavity. The preferred micronized deformable solid material is a Fischer-Tropsch wax such as highly oxidized polymethylene wax.

The method of forming powder metal compositions according to the invention comprises blending the base metal particles, the lubricant and the micronized deformable solid material together to form a substantially homogeneous mixture. The amount of lubricant present in the powder metal composition is preferably the least amount sufficient to facilitate the efficient compaction of the base metal particles during pressing. In another embodiment of the invention, this amount is selected in view of the height and complexity of the metal part being formed. The amount of the micronized deformable solid material present in the powder metal composition is selected in view of the calculated void space between the base metal particles at a predetermined green density, and the volume of such calculated void space that is occupied by the lubricant and any optional alloying components present in the powder metal composition.

Metal parts formed from powder metal compositions according to the invention achieve higher green density than metal parts formed using powder metal compositions that comprise the same base metal particles but do not contain the combination of a solid-to-liquid phase changing lubricant and the micronized deformable solid material. Higher green density leads directly to higher sintered density and superior physical properties in the final part. In addition, final parts formed using the powder metal compositions and method of the invention do not exhibit defects arising from delamination and/or cracking of the green compact.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

The base metal particles in the powder metal compositions according to the present invention can comprise relatively pure elemental metals, alloys of two or more metals and/or physical blends or mixtures thereof. Preferred base metal particles for use in the invention include, but are not limited to, iron and steel powders, stainless steel powders, nickel powders, copper powders and brass powders. Such metal powders are commercially available from a variety of sources in a variety of sizes and surface morphologies (e.g., flakes and spheres). It is believed that the principles of the invention can also be applied to other pressable inorganic powders (e.g., ceramic particles, intermetallic particles, oxides, carbides etc.). U.S. Pat. No. 6,093,761, from col. 10, line 27 to col. 11, line 20, is hereby incorporated by reference for its teachings relative to the composition of pressable inorganic powders.

The lubricant in the powder metal composition may comprise one or more of the conventional lubricants available for use in pressed powder metallurgy (e.g. zinc stearate and/or ethylene bis-stearamide wax). However, distinct advantages can be realized through the use of a lubricant composition that transforms from a solid phase material to a viscous liquid phase material when the powder metal composition is pressed to form the green compact. Such a lubricant composition is described in U.S. Pat. No. 6,679,935, which is hereby incorporated by reference in its entirety.

The lubricant is preferably mixed with the dry base metal particles and other optional alloying and/or processing components of the powder metal composition as a solid phase material, and continues to remain as a solid phase material under conventional mold cavity filling conditions. However, when exposed to conventional shear stresses in the pressing step, the lubricant transforms from a solid phase material to a highly lubricating viscous liquid phase material that forms a lubricating viscous film that allows the individual base metal particles to slide relatively to each other and efficiently compact together, taking up less volume in the mold cavity and thereby reducing internal void space in the green compact.

The presently most preferred lubricant that transforms from a solid phase material to a viscous liquid phase material during pressing for use in the invention is commercially available from Apex Advanced Technologies, LLC of Cleveland, Ohio under the trade designation SUPERLUBE PS1000B. This lubricant comprises, by weight, about 10% lauric acid, about 10.99% stearic acid, about 0.54% guanidine stearate, about 0.60% guanadine 2-ethyl hexonate, about 11.8% microcrystalline wax, about 17.5% polyethylene copoylmer wax, and about 48.57% of N,N'-ethylene bis-stearamide.

The amount of the lubricant that transforms from a solid phase material to a viscous liquid phase material during pressing present in the powder metal composition is preferably the least amount sufficient: (1) to facilitate the efficient compaction of the base metal particles during pressing; and (2) to facilitate ejection of the green compact from the mold cavity after pressing. In accordance with a method of formulating a powder meal composition according to the invention, this amount is selected based on the height and complexity of the metal part being formed. For metal parts that are up to about ⅜" in height, the loading of the lubricant that transforms from a solid phase material to a viscous liquid phase material during pressing (e.g., SUPERLUBE PS1000B) need only be about 0.20% to about 0.30% by weight, and more preferably from about 0.25% to about 0.27% by weight, based on the total weight of all of the components of the powder metal composition. For moderately complex metal parts that are from about ⅜" to about 1" in height, the loading of such a lubricant need only be about 0.25% to about 0.35% by weight, and more preferably from about 0.29% to about 0.31% by weight, based on the total weight of all of the components of the powder metal composition. For metal parts that are greater than about 1" in height, the loading of such a lubricant need only be about 0.35% to about 0.45% by weight, and more preferably from about 0.39% to about 0.41% by weight, based on the total weight of all of the components of the powder metal composition. It will be appreciated that more complex metal parts and/or parts having a greater surface area will tend to need a higher loading of the lubricant within the range specified than simple parts having a minimal surface area.

The powder metal composition according to the invention further comprises an amount of a micronized deformable solid material sufficient to fill at least a portion of the void space in the powder metal composition during the pressing or compaction step, thereby occupying void space in the green compact where the viscous liquid phase lubricant could reside, which forces at least a portion of the lubricant to migrate or exude to the surface of the green compact where it interfaces with the walls of the mold cavity. The micronized deformable solid material must have a small particle size, typically having an average particle diameter ($D_{50}$) of less than about 40 μm. It must not react chemically with the lubricant or the other components of the powder metal composition. It must be capable of deforming to fill the void spaces between the metal particles and any other optional components that may be in the powder metal composition, thereby displacing at least a portion of the viscous liquid phase lubricant without taking up additional volume or creating additional void space in the green compact. In addition, the micronized deformable solid material must be able to burn out cleanly and leave no undesirable combustion or decomposition products during the heating step.

As noted above, because the micronized deformable solid material fills at least a portion of the void space between the compressed base metal particles in the green compact, at least a portion of the viscous liquid phase lubricant is free to migrate to the interface between the surface of the green compact and the walls of the mold cavity where it can serve as a lubricant that reduces the ejection force necessary to remove the green compact from the mold cavity. The use of the micronized deformable solid material eliminates the need to use an excessive amount of an internal lubricant to accomplish part surface lubrication. Furthermore, the presence of the micronized deformable solid material in the pressed green compact has the added benefit as functioning as a binder, which aids in maintaining and enhancing the green strength of the green compact. Thus, the micronized deformable solid material comprises a material that: (1) does not interfere with the powder metal composition compaction process; (2) deforms and slides with lubricant movement; (3) allows for the use of the solid-to-liquid phase changing lubricant at a level which has been determined to maximize its effectiveness in forming a part with maximum green density at a given pressure; and (4) provides sufficient lubrication between the surface of the green compact and the walls of the mold cavity to allow the green compact to be ejected from the mold using minimal ejection force.

Fischer-Tropsch waxes having a high degree of oxidation are preferred for use as the micronized deformable solid material. The presently most preferred highly oxidized Fischer-Tropsch wax for use in the invention is a highly oxidized polymethylene wax. Polymethylene wax is soft, which necessitates that it be milled under cryogenic conditions in order to obtain particles having a very fine diameter (e.g., $D_{50}$<40 μm). Micronized polymethylene wax is very deformable under conventional powder metal pressing conditions. It does not react with the base metal particles, nor does it react with or adversely affect the lubrication ability of the lubricant. In addition, polymethylene wax can be effectively removed from green compacts using conventional preheating and sintering cycles. It will be appreciated that micronized deformable solid materials other than polymethylene wax may be used in the invention provide such materials do not interfere with the effectiveness of the lubricant or degrade the properties of the final metal part obtained after sintering.

Powder metal compositions according to the invention can further optionally comprise one or more additives such as, for example, alloying materials (e.g., graphite and/or particles of alloying metals), which are sometimes present in pressed powder metal compositions. The base metal particles, lubricant, micronized deformable solid material, and any optional additives are blended together to create a substantially homogenous powder metal composition. Mixing assures that the lubricant, micronized deformable solid material and optional additives are evenly distributed throughout the base metal particles so that a green compact having uniform density and structure is obtained subsequent to pressing.

The present invention also provides a method of selecting an amount of the micronized deformable solid material to be included in the powder metal composition in order to obtain a green compact having a green density that exceeds the green density obtainable using conventional internal lubricants, and which can be ejected from a mold cavity after pressing using an amount of ejection force that is lower than can be obtained using conventional internal lubricants. With adequate lubrication between the base metal particles, maximum green density is a function of the concentration and composition of the various constituents of the powder metal composition, the volume of the micronized deformable solid material added to the powder metal composition to reduce and/or eliminate void space upon pressing, and the pressing conditions (e.g., pressure) utilized to form the green part.

In order to determine the amount of micronized deformable solid material to be included in the powder metal composition, the practical achievable green density of the base metal particles present in the powder metal composition at a given pressure must be known. The practical achievable green density can be determined by pressing samples of the base metal particles mixed with 0.35% by weight of a solid-to-liquid phase-changing lubricant system such as SUPERLUBE PS1000B at predetermined pressures. No other components are pressed with the base metal particles and the lubricant to make this determination, but a conventional die wall lubricant must be applied to the mold cavity in order to eject the pressed samples. The base metal particles and lubricant mixture is pressed at 30, 40, 50 and 60 TSI, and the green density of the resulting pressed samples is measured. The green density data is then preferably recorded in a database or spreadsheet so that the practical achievable green density for the particular base metal particles need not be repeated for future parts made from such material.

Once the practical achievable green density of the base metal particles present in the powder metal composition at a given press pressure is known, the theoretical percentage of maximum volume occupied by the base metal particles in the green compact at that pressure can be calculated as a function of the specific gravity of the base metal. To make this calculation, the practical achievable green density of the sample at the desired pressure is divided by the specific gravity of the base metal, and the result is then multiplied by one hundred (100) to obtain a value that represents the theoretical percentage of maximum volume occupied by the pressed base metal particles. To determine the theoretical percentage of void space remaining in the green compact pressed at that pressure, one would simply subtract the theoretical percentage of maximum volume occupied by the pressed base metal particles from 100 percent.

Once the theoretical percentage of maximum volume occupied by the pressed base metal particles at the desired pressure is known, an accounting must be made for the theoretical percentage of maximum volume occupied by the other components present in the powder metal composition (e.g., the lubricant and any optional additives), except for the micronized deformable solid material. The theoretical percentage of maximum volume occupied by the other components present in the powder metal composition (except for the micronized deformable solid material) is calculated by determining the weight percent fraction of such components in the powder metal composition, and then by determining the theoretical percentage of maximum volume occupied by such components based on the specific gravity of such components relative to the specific gravity of the base metal.

The sum of the theoretical percentage of maximum volume occupied by the pressed base metal particles at the desired pressure and the theoretical percentage of maximum volume occupied by the other components present in the powder metal composition (e.g., the lubricant and any option additives, but not the micronized deformable solid material) will often be less than 98% of maximum volume. Thus, in accordance with the method of the invention, an amount of the micronized deformable solid material is added to the powder metal composition sufficient that the sum of the theoretical percentage of maximum volume occupied by all of the components of the powder metal composition (e.g., base metal particles, lubricant, optional additives and micronized deformable solid material) is from about 98% to about 100% of maximum volume (maximum volume being a function of the specific gravity of the base metal).

When an amount of micronized deformable solid material sufficient to bring the sum of the theoretical percentage of maximum volume occupied by all of the components of the powder metal composition to a value within the range of from about 98% to about 100% of maximum volume, at least a portion of the lubricant in its viscous liquid phase is pressed to the die wall due to the collapse of the pores or closing of the open space in the green compact. The lubricant thus serves as an internal lubricant to maximize the efficiency of metal particle compaction, and also a die wall lubricant that allows for efficient ejection of the green compact after pressing. At higher pressing pressures (e.g., 60 TSI), the amount of micronized deformable solid material present in the powder metal composition should be sufficient to make the sum of the theoretical percentage of maximum volume occupied by all of the components of the powder metal composition (e.g., base metal particles, lubricant, optional additives and micronized deformable solid material) approach about 100% of maximum volume. At lower pressing pressures (e.g., from about 40-45 TSI), the amount of micronized deformable solid material present in the powder metal composition should be sufficient to make the sum of the theoretical percentage of maximum volume occupied by all of the components of the powder metal composition (e.g., base metal particles, lubricant, optional additives and micronized deformable solid material) approach 98% of maximum volume. It will be appreciated, however, that the method is simply a tool for predicting the optimal amount of the micronized deformable solid material for a particular powder metal composition, and that the actual optimal amount may need to be adjusted upwardly or downwardly in practice.

The present invention provides many advantages and benefits. No special set up is required. Because the powder metal composition has a relatively low lubricant content and the lubricant is in a solid phase during filling operations, the stroke rate can be increased. An increase in the stroke rate allows for sufficient shear stress between the particles to transform the solid phase lubricant into a viscous, liquid phase material at lower pressing pressures. Because the green density of green compacts produced from powder metal compositions according to the invention tends to be higher than conventional powder metal compositions at comparable pressing conditions, the compressibility curve can be modified to allow for the production of larger parts at lower tonnage using the same press. Tool wear is reduced due to better lubrication and/or a lowering of pressure. Final parts made from the powder metal compositions according to the invention exhibit an improved surface finish as compared to final parts made by conventional means using the same base metal particles. And, the physical properties of the final part (e.g., density, strength etc.) are improved by about 15 to about 20 percent as compared to final parts made by conventional means using the same base metal particles.

The combination of the lubricant and the micronized deformable solid material allows for efficient base metal particle movement and compaction, which equalizes green density. This eliminates density gradients in parts, eliminates micro-cracking, and reduces the risk of molding cracks. The micronized deformable solid material and the lubricant are formed of components that decompose at different temperatures, which allows for a staggered or staged burn out. Sintered parts exhibit excellent dimensional stability. Higher density parts can be obtained (e.g., steel parts with green densities from about 7.2 to about 7.4 g/cc) without the need for double pressing or double sintering. Predictability of the method is robust, and the method provides a very viable tool for optimizing compositional needs during new part development and problem solving.

The following examples are intended only to illustrate the invention and should not be construed as imposing limitations upon the claims.

EXAMPLE 1

Preparation of a Solid-to-Liquid Phase Changing Lubricant System 10 grams of lauric acid and 10.99 grams of stearic acid were ground together in a Waring blender until the particles would pass through a 100-mesh sieve. The ground acids were combined with 0.54 grams of guanidine stearate, 0.66 grams of guanidine ethyl-hexanoate, 11.8 grams of microcrystalline wax, 17.5 grams of polyethylene copolymer wax and 48.57 grams of N,N'-ethylene bis-stearamide and double cone mixed and then melt mixed together at 160° C. The melt mixed product was then cryogenically ground to provide particles of a solid-to-liquid phase changing lubricant system having an average particle size of from about 10 to about 25 μm.

EXAMPLE 2

Preparation of a Micronized Deformable Solid Material

A Fischer-Tropsch wax, namely, SASOLWAX A1, was obtained from Sasol Wax of South Africa. The SASOLWAX A1 material was an odorless, white to off-white water-insoluble powder having a drop melting point of 102° C., a density at 25° C. of 0.90 g/cc, and an acid value (ASTM D 1386/7) of 27-29 mg KOH/g, indicating a high level of oxidation. Penetration was carried out at 25° C. according to ASTM D1321 to produce granules having a dimension of about 4.0 mm to about 8.0 mm. The granules were then crushed to obtain particles, which were cryogenically milled to a $D_{50}$ of less than about 40 μm.

EXAMPLE 3

Formulation of Base Powder Metal Composition 97.5 parts by weight of a water atomized, pre-alloyed steel powder (composition, by weight: carbon <0.01%; manganese 0.12%; molybdenum 0.86%; oxygen 0.08%; balance iron) sold under the trade designation ANCORSTEEL 85 HP by Hoeganaes Corporation of Cinnaminson, N.J. was thoroughly mixed with 2.0 parts by weight of a nickel powder for powder metallurgy applications and 0.5 parts by weight of graphite to form a Base Powder Metal Composition.

EXAMPLE 4

Formulation of Powder Metal Compositions

The amounts of the lubricants and deformable micronized solid materials shown in parts by weight in Table 1 below were added to 100 parts by weight of the Base Powder Metal Composition formed in Example 3, and intimately mixed to form Powder Metal Compositions ("P/M C") A through H:

TABLE 1

| P/M C | Base Powder Metal Composition | KENOLUBE(1) | ACRAWAX C(2) | SUPERLUBE PS1000B(3) | SASOLWAX A1(4) |
|---|---|---|---|---|---|
| A | 100 | 0.75 | — | — | — |
| B | 100 | — | 0.75 | — | — |
| C | 100 | — | — | 0.35 | — |
| D | 100 | — | — | 0.35 | 0.1 |
| E | 100 | — | — | 0.35 | 0.35 |
| F | 100 | — | — | 0.35 | 0.50 |
| G | 100 | — | — | 0.35 | 0.65 |
| H | 100 | — | — | 0.35 | 0.80 |

Notes:

(1)KENOLUBE is believed to be a mixture of a synthetic fatty diamide wax and zinc stearate that is commercially available from North American Hoganas, Inc. of Hollsopple, PA;

(2)ACRAWAX is believed to be a mixture of N,N'-ethylenebisstearamide wax and stearic acid that is commercially available from Lonza Inc. of Allendale, NJ;

(3)SUPERLUBE PS1000B comprises, by weight, about 10% lauric acid, about 10.99% stearic acid, about 0.54% guanidine stearate, about 0.60% guanadine 2-ethyl hexonate, about 11.8% microcrystalline wax, about 17.5% polyethylene copoylmer wax, and about 48.57% ACRAWAX C, and is commercially available from Apex Advanced Technologies, LLC of Cleveland, Ohio; and (4)SASOLWAX A1 is a substantially linear, saturated, straight chain synthetic polymethylene Fischer-Tropsch wax that has been oxidized and is commercially available from Sasol Wax Americas, Inc. of Shelton, Connecticut.

EXAMPLE 5

Physical Characteristics of P/M Compositions

Samples of P/M Compositions A through H from Example 4 were each separately pressed until a green part having a 7.0 g/cc green density was obtained. The compaction force in TSI required to obtain a green part exhibiting a 7.0 g/cc green density, the calculated volume contributed by all constituents of the P/M Composition, the Peak Force (in ft.-lbs) needed to free the part from the die cavity, the Slide Force (in ft.-lbs) needed to eject the part from the die cavity, the dimensional change in the part upon pressing and the green strength of the pressed part are reported in Table 2 below for each P/M Composition:

TABLE 2

| P/M C | Green Density | Compaction Force | Calculated Volume | Peak Force | Slide Force | Dimensional Change | Green Strength |
|---|---|---|---|---|---|---|---|
| A | 7.0 g/cc | 42 TSI | — | 2608 | 1875 | 0.19% | 2024 PSI |
| B | 7.0 g/cc | 40 TSI | — | 2398 | 2025 | 0.17% | 1710 PSI |
| C | 7.0 g/cc | 36.5 TSI | 91.98% | 3018 | 1992 | 0.17% | 1580 PSI |
| D | 7.0 g/cc | 35 TSI | 96.93% | 2255 | 1550 | 0.17% | 1480 PSI |
| E | 7.0 g/cc | 37 TSI | 98.44% | 2394 | 1400 | 0.17% | 1827 PSI |
| F | 7.0 g/cc | 37 TSI | 98.94% | 2186 | 1400 | 0.19% | 1888 PSI |
| G | 7.0 g/cc | 37 TSI | 100.60% | 2005 | 1325 | 0.17% | 1911 PSI |
| H | 7.0 g/cc | 41 TSI | 101.64% | 1854 | 1175 | 0.20% | 1922 PSI |

The data reported in Table 2 shows that a relatively low compaction force can be used to form a part having excellent green strength, which can be ejected from a die cavity without an external lubricant, when the powder metallurgy composition comprises a relatively small amount of a solid-to-liquid phase changing lubricant and an amount of a micronized deformable solid material sufficient to bring the calculated volume of the constituents of the powder metallurgy composition to the range of from about 98% to about 100% of the volume of the part (see P/M Compositions E, F and G). When the volume is below about 98%, there is adequate internal lubrication for the metal particles, as noted by the relatively low compaction force necessary to obtain a desired green density (see P/M Compositions C and D), but the slide force and green strength of the part are not optimal. When the volume is above about 100%, the additional volume provided by the micronized deformable solid material makes it difficult to obtain green density, as is noted by the increase in compaction force.

EXAMPLE 6

100 parts by weight of a highly compressible iron powder sold under the trade designation ANCORSTEEL 1000C by Hoeganaes Corporation of Cinnaminson, N.J. were thoroughly mixed with the amounts of the lubricants and micronized deformable solid materials shown in parts by weight in Table 3 below to form Powder Metallurgy Compositions (P/M C) 6A through 6D.

TABLE 3

| P/M C | ANCORSTEEL 1000C | ACRAWAX C | SUPERLUBE PS1000B | SASOLWAX A1 |
|---|---|---|---|---|
| 6A | 100 | 0.51 | — | — |
| 6B | 100 | — | 0.35 | 0.14 |

TABLE 3-continued

| P/M C | ANCORSTEEL 1000C | ACRAWAX C | SUPERLUBE PS1000B | SASOLWAX A1 |
|---|---|---|---|---|
| 6C | 100 | 0.71 | — | — |
| 6D | 100 | — | 0.35 | 0.31 |

The resulting P/M Compositions 6A, 6B, 6C and 6D, respectively, were pressed to 60 TSI. Calculated Volume, Peak Force and Slide Force are reported in Table 4 below:

TABLE 4

| P/M C | Total Additive Weight | Calculated Volume | Peak Force (ft.-lbs) | Slide Force (ft.-lbs) |
|---|---|---|---|---|
| 6A | 0.51 | 98.56% | 3727 | 2533 |
| 6B | 0.49 | 98.56% | 3257 | 1850 |
| 6C | 0.71 | 100% | 3113 | 2533 |
| 6D | 0.66 | 100% | 2776 | 1625 |

The data in Table 4 shows that at identical calculated volume, the inventive compositions according to the invention (see P/M Compositions 6B and 6D) provide reduced Peak Force and Slide Force needs, and do so with less lubricant and total additives by weight (lubricant plus micronized deformable solid material).

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A powder metal composition comprising:

base metal particles;

a solid phase lubricant that transforms into a viscous, lubricating liquid phase material when the powder metal composition is pressed; and a cryogenically micronized highly oxidized polymethylene wax having a $D_{50}$ of less than about 40 μm;

wherein the base metal particles, solid phase lubricant, optional additives and cryogenically micronized highly oxidized polymethylene wax are physically mixed together to form a substantially homogeneous flowable dry powder.

2. The powder metal composition according to claim 1 wherein the base metal particles are selected from the group consisting of pure elemental metals, alloys of two or more metals and physical blends or mixtures of two or more thereof.

3. The powder metal composition according to claim 1 wherein the base metal particles are one or more selected from the group consisting of iron powders, steel powders, stainless steel powders, nickel powders, copper powders and brass powders.

4. The powder metal composition according to claim 1 wherein the solid phase lubricant that transforms into a viscous, lubricating liquid phase material when the powder metal composition is pressed comprises a blend of lauric acid, stearic acid, guanidine stearate, guanadine 2-ethyl hexonate, microcrystalline wax, polyethylene copoylmer wax, and N,N'-ethylene bis-stearamide.

5. The powder metal composition according to claim 4 wherein the solid phase lubricant that transforms into a viscous, lubricating liquid phase material when the powder metal composition is pressed comprises a blend of, by weight, about 10% lauric acid, about 10.99% stearic acid, about 0.54% guanidine stearate, about 0.60% guanadine 2-ethyl hexonate, about 11.8% microcrystalline wax, about 17.5% polyethylene copoylmer wax, and about 48.57% of N,N'-ethylene bis-stearamide.

* * * * *